United States Patent [19]

Collins

[11] Patent Number: 4,492,332

[45] Date of Patent: Jan. 8, 1985

[54] CARTON DIVIDER

[75] Inventor: Thomas D. Collins, Kennesaw, Ga.

[73] Assignee: Sonoco Products Company, Hartsville, S.C.

[21] Appl. No.: 565,200

[22] Filed: Dec. 23, 1983

[51] Int. Cl.[3] ..... B65D 5/48

[52] U.S. Cl. ..... 229/15; 229/42

[58] Field of Search ..... 229/15, 27, 42, 29 R, 229/29 E, 29 F, 28 R, 28 BC; 217/7, 8, 22; 493/912

[56] References Cited

U.S. PATENT DOCUMENTS 4,071,185 1/1978 Peters, Jr. ..... 229/42 X

FOREIGN PATENT DOCUMENTS 2309033 8/1974 Fed. Rep. of Germany ..... 229/15

*Primary Examiner*—William Price

*Assistant Examiner*—Gary E. Elkins

*Attorney, Agent, or Firm*—Dennison, Meserole, Pollack & Scheiner

[57] ABSTRACT

A carton divider incorporating planar partitions with internesting slots for a right angular interlocking of the partitions. One partition slot is of a constant width and includes a laterally arcing inner portion. The mating or nesting slot includes an enlarged inner portion with a tab flexibly attached to the inner end thereof, the tab having an elongated opening aligned with the slot and defining spaced side bars interconnected by a cross bar. Upon a nesting of the slots the tab is laterally deflected or cammed by the inner portion of the first slot and the side bars positioned laterally to each side of the other partition, a portion or portions of which are received between the side bars whereby relative rotation between the partitions is prevented.

8 Claims, 8 Drawing Figures

CARTON DIVIDER

BACKGROUND OF THE INVENTION

The invention herein relates to carton dividers, carton inserts formed of two or more angularly related panels or partitions interconnected by complementary nesting slots to divide the interior of a carton or container into individual cells.

It is highly desirable that these formed cells be maintained open and of a uniform size both as a means for facilitating the introduction of products thereto and as a means for properly segregating and protecting the products. The prevention of the collapse of the cells, against the normal tendency of the interengaged panels to rotate to a flat condition, is particularly significant when the product packing involves the use of high-speed automatic casing machines which rely on cell uniformity. Under such circumstances, partially collapsed dividers can cause product damage, equipment jams, and other malfunctions which can require time consuming and expensive halts in operation.

This problem of maintaining cell uniformity is particularly acute when dealing with "butterfly" dividers, that is dividers composed of a single strip or partition intersected by one or more other partitions transverse thereto. Such dividers are inherently unstable and normally incapable of maintaining cell stability even when received within a confining carton.

The problems associated with collapsing "butterfly" dividers are recognized in U.S. Pat. No. 4,071,185, issued Jan. 31, 1978. As a solution, this patent provides, at the inner end of one of the slots, an enlarged tab with an elongated central opening and two specifically defined transverse fold lines for a controlled and directed collapsing and folding of the tab. The folding of the tab is effected by an introduction of the second partition through an internesting of the slots. The provision of and position of the score lines is of particular significance to insure the proper folding of the tab to only one side of the partition from which the tab is formed. While such scores or score lines are essential for a proper operation of the patent construction, in dry finish boards of the type used in most carton partitions, the moisture content is normally not accurate enough to provide a proper scoring as would be needed for the desired unguided folding of the tab. Further, conventional partition equipment does not incorporate the means or pressure for providing score lines as proposed in the patented device.

SUMMARY OF THE INVENTION

The present invention proposes a structure and system for the interlocking of partitions, in the formation of a divider, wherein the interlocking is effected in a manner whereby rotational movement and collapsing of the partitions relative to each other is prevented. This, in turn, is significant in maintaining the cell size and configuration. The interlock is effected through a cooperative configuration of the inner ends of the nesting slots whereby a partial nesting of the partitions will leave them free for pivotal collapsing for shipping, storage, and the like, while a full nesting will produce the desired right angular non-rotating positive interlock sought in the fully assembly divider.

In effecting the desired positive interlock, a tab integrally formed within the enlarged inner end of one of the slots is laterally deflected, as an entity, to one side and in a manner whereby an adjacent portion of the second partition is received centrally through the laterally deflected tab which in turn lies to the opposite sides thereof and in close confining relation thereto. As the tab is being deflected or laterally pivoted, the generally planar nature of the tab is maintained without any collapsing or folding therof, other than for a pivoting of the tab at the point of integral attachment to the partition.

The actual deflection is effected by the inner portion of the slot in the second partition which engages the tab and, upon a continuing internesting movement of the slots relative to each other, effects a positive guided lateral camming or deflecting of the tab under positive control throughout the range of deflection of the tab. In this manner, there is no necessity for providing fold scores on the tab. Further, there is no reliance on a free folding of the tab which could easily result in an incomplete or an improper, and thus ineffective, folding. The actual guiding portion of the second slot comprises an arcuate end portion, of constant width with the remainder of the slot, extending from the main portion of the slot at a generally obtuse angle, providing in effect a camming surface which engages an appropriate crossbar on the tab for a gradual lateral turning of the tab during continued endward movement of the slots toward each other.

Once interlocked, the interengaged inner portions of the slots will maintain the partitions in positive fixed engagement with each other. This engagement is enhanced by positive frictional contact between the tab in one slot and the laterally angled guiding inner portion of the second slot. However, should subsequent disengagement of the partitions be desired this can easily be effected by the application of a positive force moving the engaged partitions outward relative to each other.

The above objects and advantages, together with others which will subsequently be recognized from the following description, are considered to reside in the details of construction and manner of use of the invention as more fully hereinafter disclosed.

DESCRIPTION OF PREFERRED EMBODIMENTS

Figure 1:
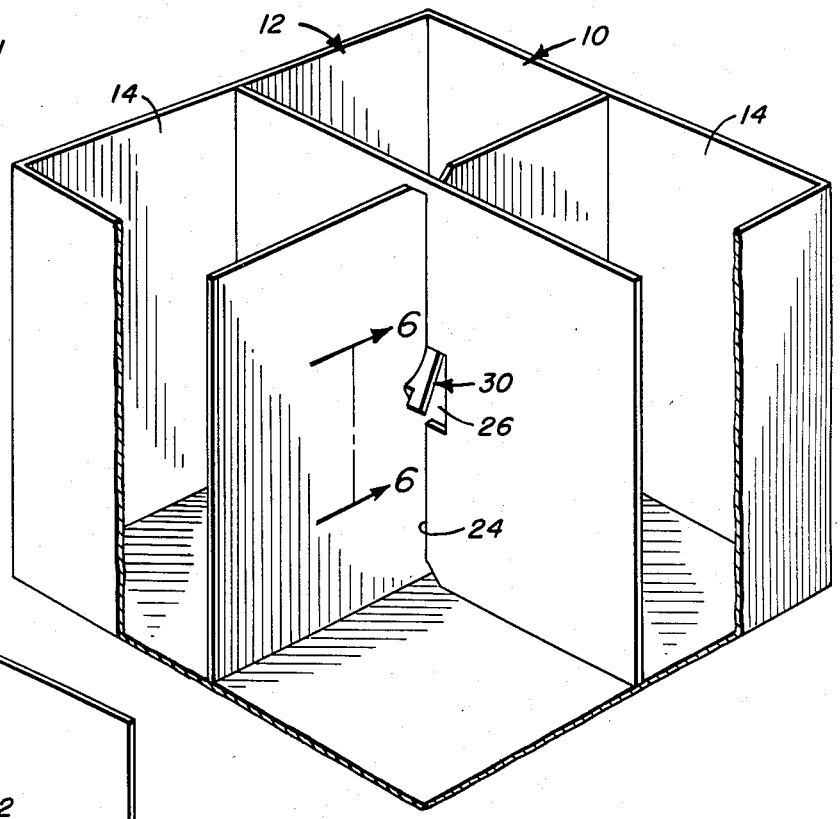
FIG. 1 is a perspective view of a carton with portions broken away to illustrate a received divider constructed in accordance with the present invention.

Referring now more specifically to the drawings, reference numeral 10 is used to generally designate a carton divider constructed in accordance with the present invention. FIG. 1 illustrates the divider 10 fully assembled and received, in operative position, in a carton or box 12 to define individual product receiving cells 14.

As illustrated, the invention is particularly concerned with butterfly dividers and a means for eliminating a significant problem associated with such dividers, that is the tendency for the dividers to collapse or fold when in a carton-received operative position.

Figure 2:
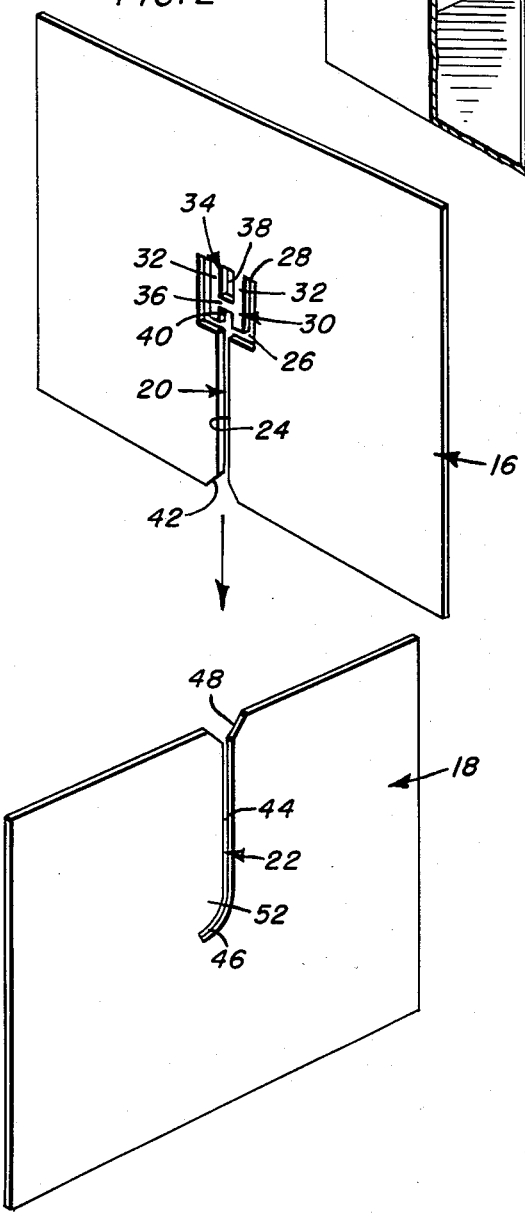
FIG. 2 is an exploded perspective view of the two partitions comprising the divider of FIG. 1.

The divider in its simplest form, includes two interengageable or internestable planar partitions 16 and 18, each normally of a rectangular configuration and formed of conventional partition material, usually cardboard. The pair of crossed and internested partitions 16 and 18, noting FIG. 2 in particular, includes elongated slots, 20 and 22 extending centrally inward through one edge of each panel respectively. These panel edges, upon an assembly of the partitions 16 and 18, will constitute the upper edge of one partition and the lower edge of the other partition.

Slot 20, in partition 16, includes an elongated narrow outer portion 24 and a laterally enlarged inner portion 26 terminating at an inner end or edge 28. A locking tab 30 extends outwardly from the inner end 28 into the inner portion 26 of the slot 20 and consists of two laterally spaced side bars 32. The side bars 32 are laterally spaced from each other to define an elongated central opening 34 divided, by an integral cross-bar 36, into an elongated tab slot 38 extending fom the inner end 28 of the slot 20, and a recess 40 opening outward through the free end of the tab 30 and in direct alignment with the inner end of the outer slot portion 24. The elongate opening 34, including the tab slot 38 and recess 40, is of substantially equal width with the outer portion 24 of the slot 20. This width is slightly greater than the thickness of the partitions for an accommodation of the transversely oriented other partition therein, with the tolerance being such as to allow for a free sliding movement of the other partition within the slot 20 while at the same time providing for a degree of lateral engagement and stability. The outer portion 24 of the slot 20, other than for a slightly enlarged mouth 42 at the edge of the partition 16, is of a constant width for the length thereof. The rectangular configuration of the inner portion 26 of the slot 20 is greater than the tab 30 and provides for a space between the side edges or walls of the inner slot portion 26 and the unattached peripheral edges of the tab 30.

The companion slot 22 in partition 18 includes a straight or linear outer portion 44 and an inner portion 46 which extends laterally from the inner end of the outer portion 44 at an obtuse angle. The slot, through the outer portion 44 and inner portion 46, is of a constant width other than for the enlarged mouth 48 at the partition edge through which the slot 22 opens. The inner portion 46 of the slot 22, which is to act as a guiding or camming means for the tab 30 as shall be explained subsequently, is preferably arcuately configured and so angled as to exert a positive laterally directing force on the tab 30.

Figure 3:
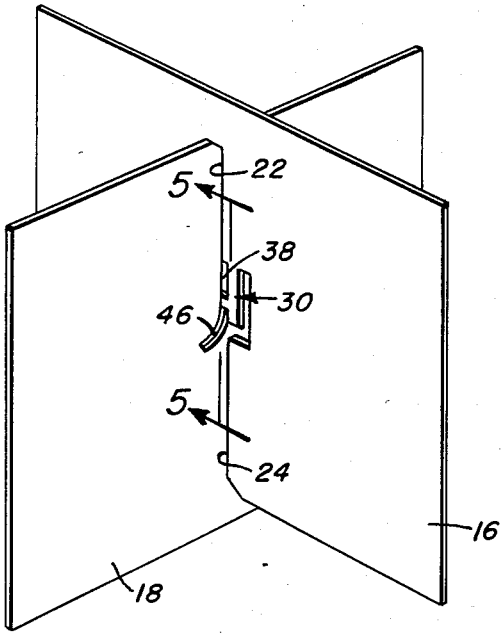
FIG. 3 is a perspective view of the partitions of the divider partially engaged or internested and at an intermediate position prior to an interlocking of the complementary inner end portions.
Figure 4:
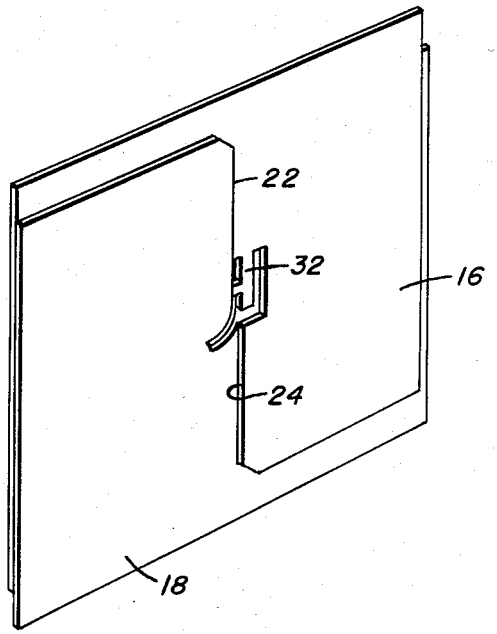
FIG. 4 is perspective view illustrating the rotatably collapsible nature of the divider of FIG. 3 with the partitions internested but not interlocked.

Referring now to FIG. 3 and 4, the partitions 16 and 18 are initially engaged by internesting the outer portions 24 and 44 of the slots 20 and 22 with an inward movement of the partitions relative to each other terminating short of an interlocking of the respective outer portions 26 and 46 of the slots. In this manner, the partitions 16 and 18, as in a conventional divider, are free to rotate relative to each other to a collapsed position for purposes of storage, shipment, or the like prior to erection thereof into an operational position. FIG. 4 illustrates such a collapsed divider.

Figure 5:
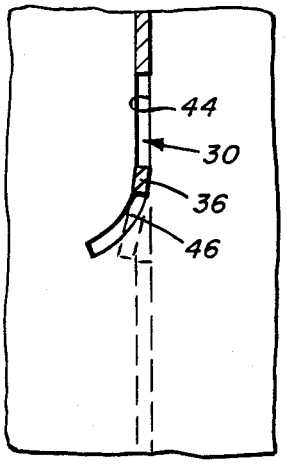
FIG. 5 is a cross-sectional detail, taken generally along the plane of line 5—5 in FIG. 3, and illustrating the tab as it initially moves into the camming or lateral guiding outer portion of the other partition.
Figure 6:
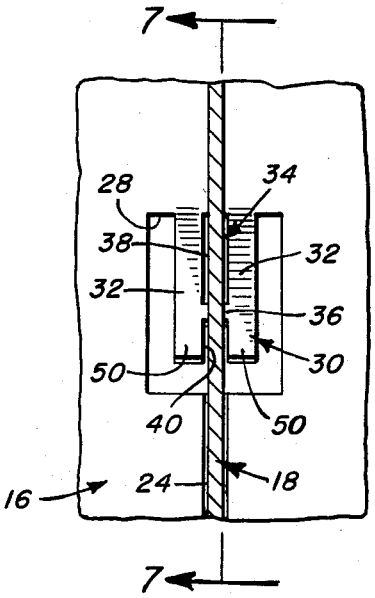
FIG. 6 is a transverse cross-sectional view taken substantially on a plane passing along line 6—6 in FIG. 1 and illustrating the full interlock of the tab carrying inner portion of one partition and the guide forming inner portion of the other partition, providing a non-rotational interengagement of the partitions.
Figure 7:
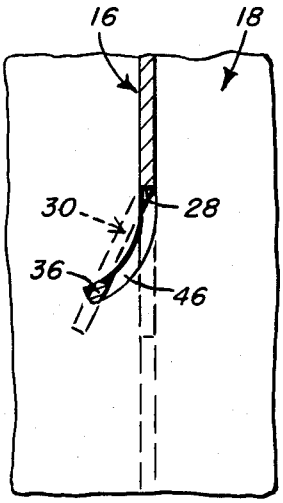
FIG. 7 is a cross-sectional detail taken substantially on a plane passing along line 7—7 of FIG. 6.

When an erection of the divider is desired, along with a locking of the partitions 16 and 18 at right angles to each other, a continued forcible movement of the partitions toward each other is effected. As this occurs, noting in particular FIG. 5, the tab 30, and more particularly the tab cross-bar 36, engages in the obtusely directed area of the inner portion 46 immediately inward of the outer portion 44 of the slot 22 and, through the camming action of the bottom edge in particular of the slot portion 46, is moved laterally into and along the length of the inner portion 46. This lateral movement of the tab 30 is basically achieved by a flexing of the tab 30 out of the plane of the partition 16 and about the area of integral attachment of the tab to the inner end or edge 28 of the slot 20. The lateral pivoting of the tab 30 continues until the cross-bar 36 seats at the innermost end of the arcuate laterally directed inner portion 46. At this point, the side bars 32 of the tab 30 are located to the opposite sides of the other partition 18, noting FIGS. 6 and 7 in particular. When so positioned, the outermost end portions of the side bars 32, constituting opposed ears 50 defining the recess 40, extend beyond the inner end of the tab guiding inner portion 46. At the same time, the elongate tab opening 38, above the cross-bar 36, receives the corner or elbow section 52 of the partition 18 defined within the angle between the inner portion 44 and the extremity of the outer portion 46 of the slot 22. Thus, the entire length of the tab side bars 32, or a significant portion thereof, lie closely adjacent to the opposite sides of the other partition 18 and effectively resist any tendency for the right-angularly related partitions to rotate or collapse relative to each other. It will be recognized that as the tab 30 starts to laterally pivot, the side bars 32 overlap the opposed sides of the other partition 18 and a stabilization of the partitions relative to each other is achieved. This stabilization is enhanced as the tab is fully pivoted.

It is contemplated that the tab 30 will, to a large degree, maintain a planar configuration and pivot outward of the plane of the associated partition 16. The inherent flexible and compressible nature of the material of the partitions facilitate a smooth guided movement of the tab cross-bar 36 within the guiding or camming inner portion 46 of the slot 22. It is to be appreciated that the length of the slots, and the relative lengths of the inner and outer portions thereof, is to be such as to achieve a substantially coplanar relationship between the respective upper edges and lower edges of the partitions as a fully nested and locked condition is achieved.

Inasmuch as a positive interlock is effected between the partitions without any substantial or destructive distortion of either partition, the formed divider can, through an outward movement of the partitions relative to each other for a disengagement of the interlocking inner portions thereof, revert to a collapsible unit for subsequent return shipment or storage for further use at a later time.

Figure 8:
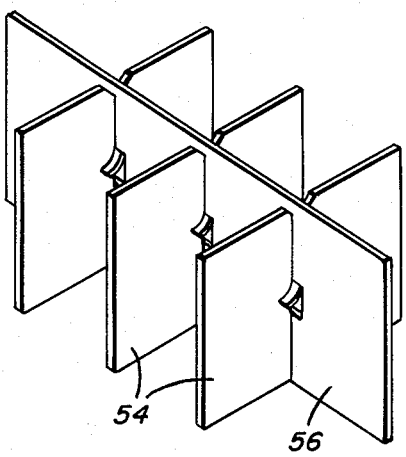
FIG. 8 is a perpsective view of another form of butterfly divider wherein a single elongated partition is intersected by a plurality of laterally spaced transverse partitions.

FIG. 8 illustrates another embodiment of butterfly divider wherein multiple transverse partitions 54 are laterally spaced along and intersect a single elongate partition 56. The internesting of the partitions is effected, in each instance, utilizing the previously described interlocking slot construction. While this multiple partition divider has been illustrated with the elongate partition 56 including multiple slots equivalent to the previously described slot 20 and the partitions 54 with slots equivalent to the slot 22, these slots may be reversed.

The foregoing is considered illustrative of an advance in the formation of butterfly dividers wherein a positive non-rotational interlock is achieved between the partitions as an inherent feature of the internesting of the partition slots. This is achieved through a slot configuration which enables the lateral directing of a locking tab without requiring an elaborate distortion of portions of the partition and the attendant problems associated therewith. To the contrary, the present invention provides for a positive and highly stable interlock by the unique expedient of effecting a positive lateral guiding of the locking tab at all stages of its movement into locking position. In regard thereto, it is to be appreciated that the angle of the guiding or camming portion of the slot constitutes the means for effecting the positive lateral guiding of the tab in response to a movement of the partitions toward each other and a force engagement of the tab with the camming surface or edge of the slot inner portion. This is best effected by providing that the obtusely angled inner camming portion be of a slightly arcuate configuration, as illustrated. the camming inner portion of the slot is also, of course, significant in acting as a means for a positive retention of the laterally angled tab at all times during full interengagement of the partitions and against any tendency for the tab to move back to the plane of its partition.

The foregoing is considered illustrative of the principles of the invention. As variations and other embodiments may occur to those skilled in the art, it is not desired to limit the invention to the exact construction illustrated. Rather, all suitable modifications and equivalents may be resorted to as fall within the scope of the invention as claimed.

I claim:

1. In a carton divider comprising a pair of planar partitions having cooperative vertical slots for an intersecting of said partitions; the slot in one partition having an inner portion and an outer portion, said inner portion being enlarged and defined by an inner edge and opposed side edges, tab means within said inner portion and including an inner end attached to the inner edge of the inner portion, said tab means being coplanar with said one partition and laterally flexible out of the plane of the one partition about the inner edge, said tab means being of greater width than the outer portion of the slot and including an outer end spanning the outer portion of the slot, said tab means including a pair of laterally spaced coplanar side bars defining a central opening therebetween aligned with the outer portion of the slot; the slot in the other partition having an outer portion internestable with the outer portion of the slot of the one partition, and an inner portion laterally extending from the outer portion of the slot of the other partition at an angle sufficient, upon advancing engagement with said outer end of the tab means, to laterally guide the tab means along the inner portion of the slot of the other partition and position the tab means side bars to the opposite sides of the other partition.

2. The divider of claim 1 wherein the laterally extending inner portion of the slot of the other partition extends from the outer portion of that slot at an obtuse angle.

3. The divider of claim 2 wherein the laterally extending inner portion extends along an arc.

4. The divider of claim 3 wherein the slot of the other partition, including the outer portion thereof and the laterally extending inner portion thereof, is of a constant width.

5. The divider of claim 4 wherein said outer end of the tab means includes a cross-bar extending transversely between said side bars for engagement by the laterally extending outer portion of the slot of the other partition.

6. The divider of claim 5 wherein said cross-bar is positioned intermediate the length of the side bars with the opening defined by the side bars extending to both sides of said cross-bar for accommodation of portions of the other partition therethrough to the opposite sides of said cross bar.

7. The divider of claim 2 wherein said outer end of the tab means includes a cross-bar extending transversely between said side bars for engagement by the laterally extending outer portion of the slot of the other partition.

8. The divider of claim 7 wherein said cross-bar is positioned intermediate the length of the side bars with the opening defined by the side bars extending to both sides of said cross-bar for accommodation of portions of the other partition therethrough to the opposite sides of said cross bar.

* * * * *